US010407958B1

(12) United States Patent
Tsou

(10) Patent No.: US 10,407,958 B1
(45) Date of Patent: Sep. 10, 2019

(54) HINGE DEVICE WITH A STOP FUNCTION

(71) Applicant: Kuo-Ho Tsou, Toufen, Miaoli County (TW)

(72) Inventor: Kuo-Ho Tsou, Toufen, Miaoli County (TW)

( * ) Notice: Subject to any disclaimer, the term of this patent is extended or adjusted under 35 U.S.C. 154(b) by 0 days.

(21) Appl. No.: 15/960,612

(22) Filed: Apr. 24, 2018

(51) Int. Cl.
*E05D 11/10* (2006.01)
*E05D 3/02* (2006.01)

(52) U.S. Cl.
CPC ..... *E05D 11/1014* (2013.01); *E05D 3/02* (2013.01); *E05D 11/1007* (2013.01); *E05D 2011/1035* (2013.01)

(58) Field of Classification Search
CPC ..... E05D 11/1014; E05D 11/1007; E05D 2011/1035
USPC ..... 16/328, 334, 344
See application file for complete search history.

(56) References Cited

U.S. PATENT DOCUMENTS 571,133 A * 11/1896 Hoffman ..... E05D 11/1078 16/303
769,035 A * 8/1904 Walter ..... E05D 11/1078 16/330
1,946,837 A * 2/1934 Clayton ..... E05D 11/1078 16/330
2,362,923 A * 11/1944 Pardoe ..... E05D 5/10 16/304
2,890,477 A * 6/1959 Miller ..... E05D 11/1085 16/322
6,665,906 B2 * 12/2003 Li ..... E05D 11/1078 16/303
6,757,940 B2 * 7/2004 Lu ..... G06F 1/1616 16/303
7,017,233 B2 * 3/2006 Hsu ..... H04M 1/0216 16/324
7,096,536 B2 * 8/2006 Johnson ..... E05D 11/1085 16/300
7,383,616 B2 * 6/2008 Duan ..... G06F 1/1616 16/303
7,533,447 B2 * 5/2009 Lu ..... G06F 1/1616 16/330
7,735,196 B2 * 6/2010 Centmayer ..... B60R 1/0617 16/330
8,556,330 B2 * 10/2013 Lazarevich ..... E05D 7/1005 16/262

(Continued)

*Primary Examiner* — Jeffrey O'Brien
(74) *Attorney, Agent, or Firm* — Alan D. Kamrath; Mayer & Williams PC

(57) ABSTRACT

A hinge device includes a first connecting member and a second connecting member pivotably connected to the first connecting member by an axle. A rotary member and a limiting member are mounted in the axle. The rotary member includes a at least one positioning groove. The limiting member includes at least one positioning leg. The rotary member is actuatable by the first connecting member to pivot about the axle. The limiting member is fixed on the axle. The limiting member is located between the rotary member and a retaining device biasing the limiting member toward the rotary member. When the first connecting member pivots through an angle relative to the second connecting member, the at least one positioning leg engages with the at least one positioning groove, thereby positioning the first connecting member relative to the second connecting member.

8 Claims, 14 Drawing Sheets

(56) References Cited

U.S. PATENT DOCUMENTS

| | | | | |
|---|---|---|---|---|
| 8,745,822 | B2 * | 6/2014 | Garrett | E05D 5/0246 16/252 |
| 9,759,000 | B2 * | 9/2017 | Stuart | E05D 5/06 |
| 2003/0009851 | A1 * | 1/2003 | Oshima | G06F 1/1616 16/334 |
| 2014/0259532 | A1 * | 9/2014 | Millard | E05D 11/1028 16/326 |
| 2015/0204125 | A1 * | 7/2015 | Van Gennep | E05D 11/1007 16/328 |
| 2018/0016826 | A1 | 1/2018 | Tsou | |

* cited by examiner

HINGE DEVICE WITH A STOP FUNCTION

BACKGROUND OF THE INVENTION

The present invention relates to a hinge device and, more particularly, to a hinge device with a stop function for retaining a door that has been opened through a certain angle.

A hinge generally includes two connecting members pivotably connected to each other and respectively mounted to a door frame and a door, permitting the door to pivot relative to the door frame. However, the hinge does not provide a positioning effect. If it is desired to retain the door in an open state, a retaining member disposed on the door or the ground is required, which is inconvenient as well as adversely affects the original indoor decoration. U.S. Publication No. 2018/0016826 A1 discloses a hinge device with a magnetic retaining function. After the door has reached a certain opening angle, the hinge device provides a magnetic attraction force therein to provide a retaining function, such that the door can be opened smoothly. However, the retaining ability is limited by the magnitude of the magnetic force. Furthermore, magnetic structure and the magnitude of the magnetic force are apt to be adversely affected during manufacture, resulting in poor stability.

BRIEF SUMMARY OF THE INVENTION

The primary objective of the present invention is to provide a hinge device including a rotary member and a limiting member to cooperate with a retaining device. After the door has been opened, the rotary member engages with the limiting member to provide a stop function. Furthermore, the hinge device can be installed on a left-handed door or a right-handed door according to the need, such that the left-handed door or the right-handed door can be retained in the open state after having been smoothly opened. The structure of the hinge device is simple and reliable and has a low cost.

To fulfill the above objective, the present invention provides a hinge device including a first connecting member and a second connecting member pivotably connected to the first connecting member by an axle. A positioning device is mounted in the first connecting member. The positioning device includes a rotary member and a limiting member. The rotary member and the limiting member are mounted in the axle. The rotary member includes a first surface facing the limiting member. The first surface of the rotary member includes at least one positioning groove. The limiting member includes a first surface facing the rotary member. The first surface of the limiting member includes at least one positioning leg for releasably coupling with the at least one positioning groove. The rotary member is actuatable by the first connecting member to pivot about the axle. The limiting member is fixed on the axle. A retaining device is mounted in the first connecting member and is mounted on top of the limiting member. The limiting member is located between the retaining device and the rotary member. The retaining device biases the limiting member toward the rotary member. When the first connecting member pivots through an angle relative to the second connecting member, the at least one positioning groove of the rotary member is aligned with the at least one positioning leg of the limiting member, and the at least one positioning leg engages with the at least one positioning groove, thereby positioning the first connecting member relative to the second connecting member.

In an example, the at least one positioning groove includes a plurality of positioning grooves spaced from each other, and the at least one positioning leg includes a plurality of positioning legs spaced from each other.

In an example, the retaining device includes an elastic element, a fastener, a positioning member, and an abutting member. The elastic element includes two ends respectively abutting against the positioning member and the abutting member. The abutting member abuts against a second surface of the limiting member away from the rotary member.

In an example, the positioning member includes a first coupling portion, and the abutting member includes a second coupling portion facing the first coupling portion. The elastic element is a compression spring having the two ends. The two ends of the compression spring are respectively coupled to the first coupling portion and the second coupling portion. The positioning member further includes an adjusting portion opposite to the first coupling portion. The fastener extends through the positioning member, the elastic element, and the abutting member in sequence and is fixed to the axle. The fastener abuts against the adjusting portion of the positioning member. A pressing force acting on the abutting member by the elastic element is adjustable by changing a length of the adjusting portion.

In an example, the axle includes a base. A fixing portion extends from a side of the base and includes an outer periphery having non-circular cross sections. The second connecting member includes a receiving space having cross sections identical to the non-circular cross sections of the fixing portion. The fixing portion is securely received in the receiving space. The base includes a positioning hole. An elastic element and two positioning pins are received in the positioning hole. The elastic element is located between the two positioning pins. The first connecting member includes a positioning space therein. The positioning space includes an inner periphery having a guiding groove. The base is received in the positioning space. The positioning pins are biased by the elastic element to extend into the guiding groove, and the first connecting member is pivotable about the base.

In an example, the axle includes a base having two sides. A fixing portion and a shank portion respectively extend from the two sides of the base. The shank portion includes a distal end having an outer periphery. The outer periphery of the distal end of the shank portion includes a positioning face with non-circular cross sections. The first connecting portion is pivotably connected to the base portion. The second connecting member is securely fixed to the fixing portion. The rotary member of the positioning device includes a pivotal space pivotably receiving the shank portion of the axle. The limiting member includes a limiting space having cross sections identical to the cross sections of the positioning face of the shank portion. The rotary member includes an outer periphery having an abutting face with non-circular cross sections. The first connecting member includes an actuation space therein. The actuation space has cross sections identical to the cross sections of the abutting face, such that the rotary member is pivoted by pivotal movement of the first connecting member.

In an example, the base of the axle includes a limiting block protruding from a location adjacent to the shank portion. A limiting leg extends downward from a second surface of the rotary member opposite to the first surface of the rotary member. The limiting leg is located on a side of the limiting block, thereby restraining a pivotal range of the rotary member.

In an example, the rotary member of the positioning device includes two guiding faces respectively on two sides of the at least one positioning groove.

In an example, the limiting member of the positioning device includes two sliding faces respectively on two sides of the at least one positioning leg.

The present invention will become clearer in light of the following detailed description of illustrative embodiments of this invention described in connection with the drawings.

DETAILED DESCRIPTION OF THE INVENTION

Figure 1:
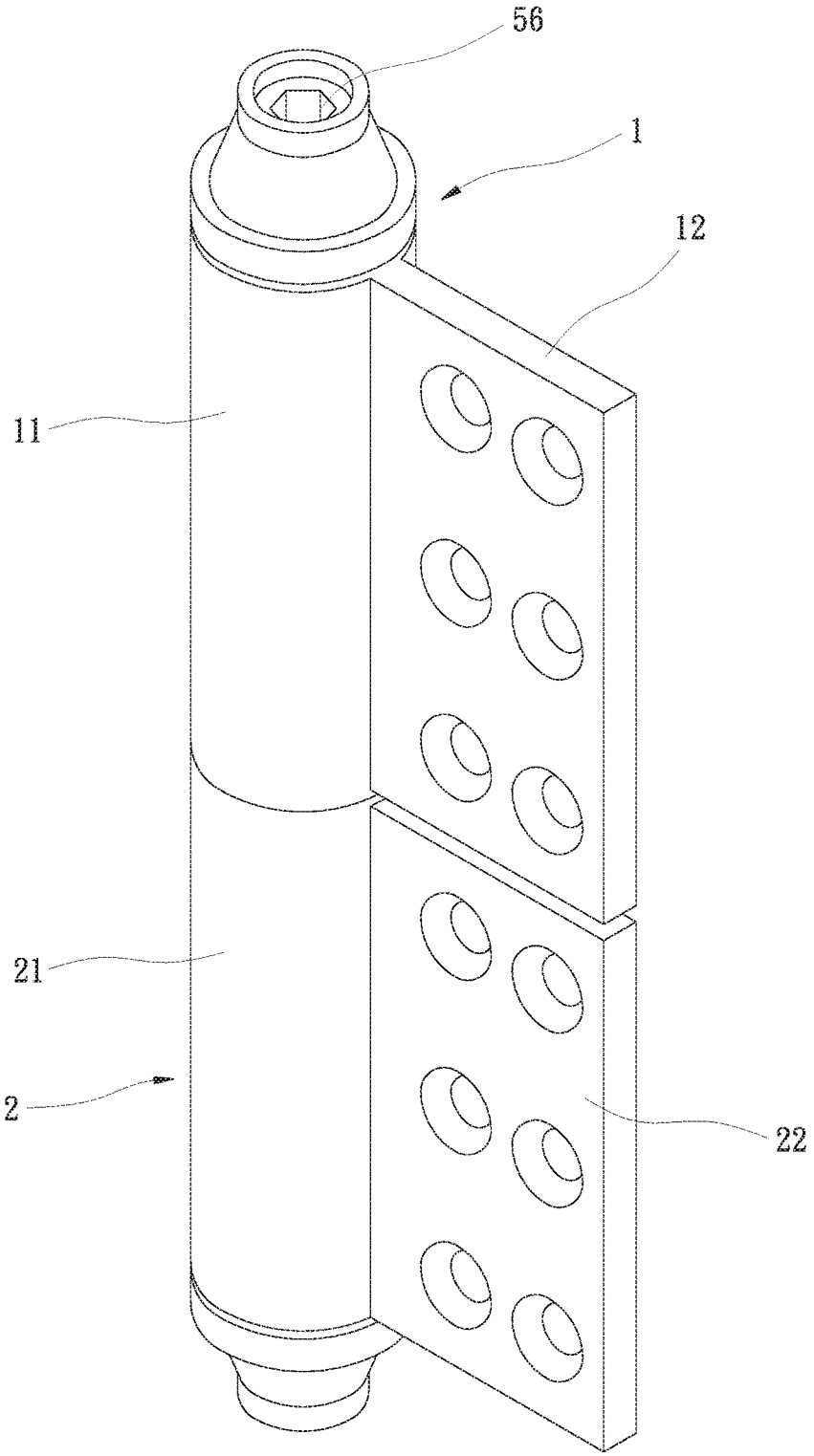
FIG. 1 is a perspective view of a hinge device according to the present invention in a closed state.
Figure 2:
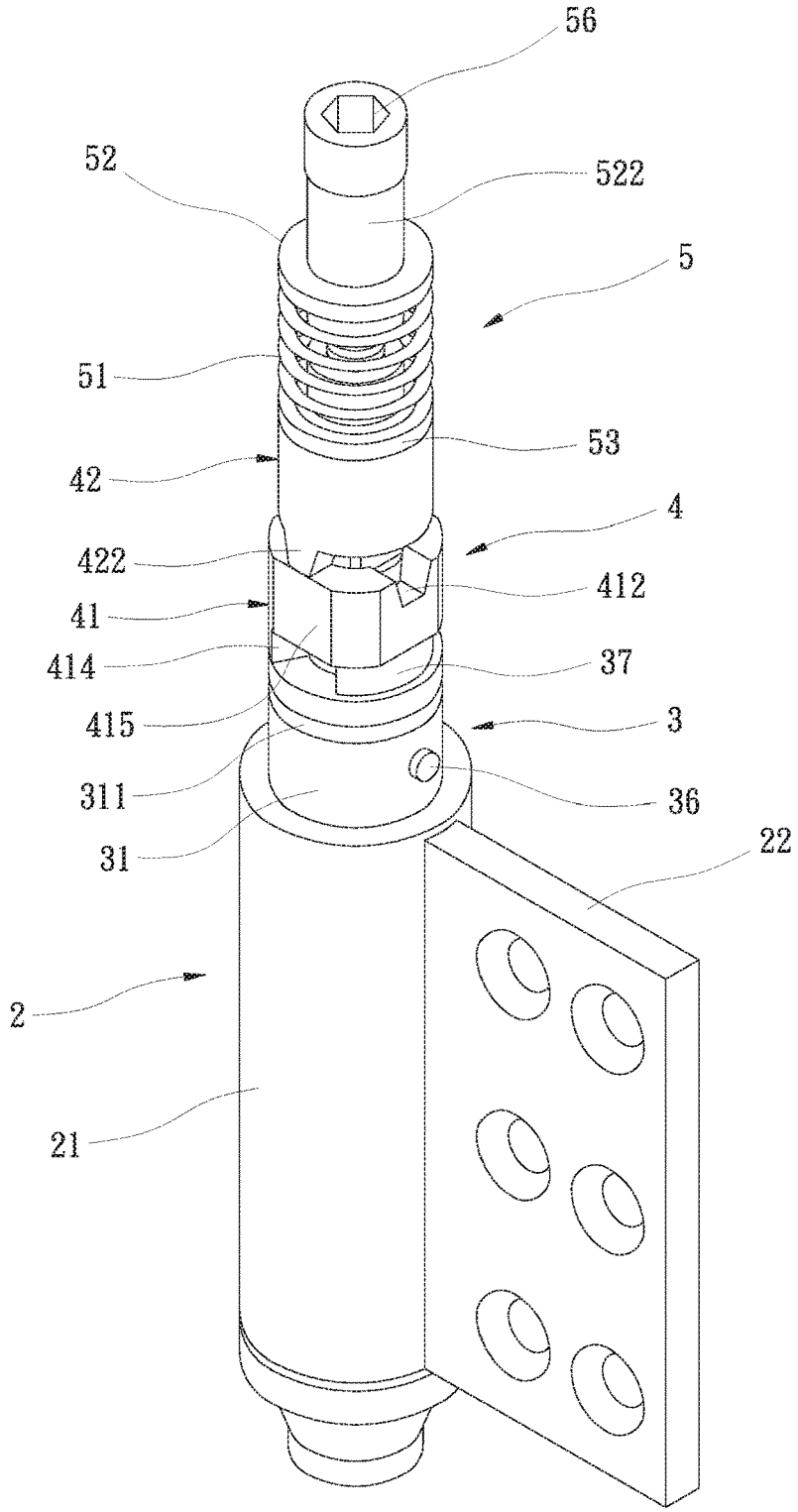
FIG. 2 is a partial, perspective view of the hinge device of FIG. 1 in the closed state.
Figure 3:
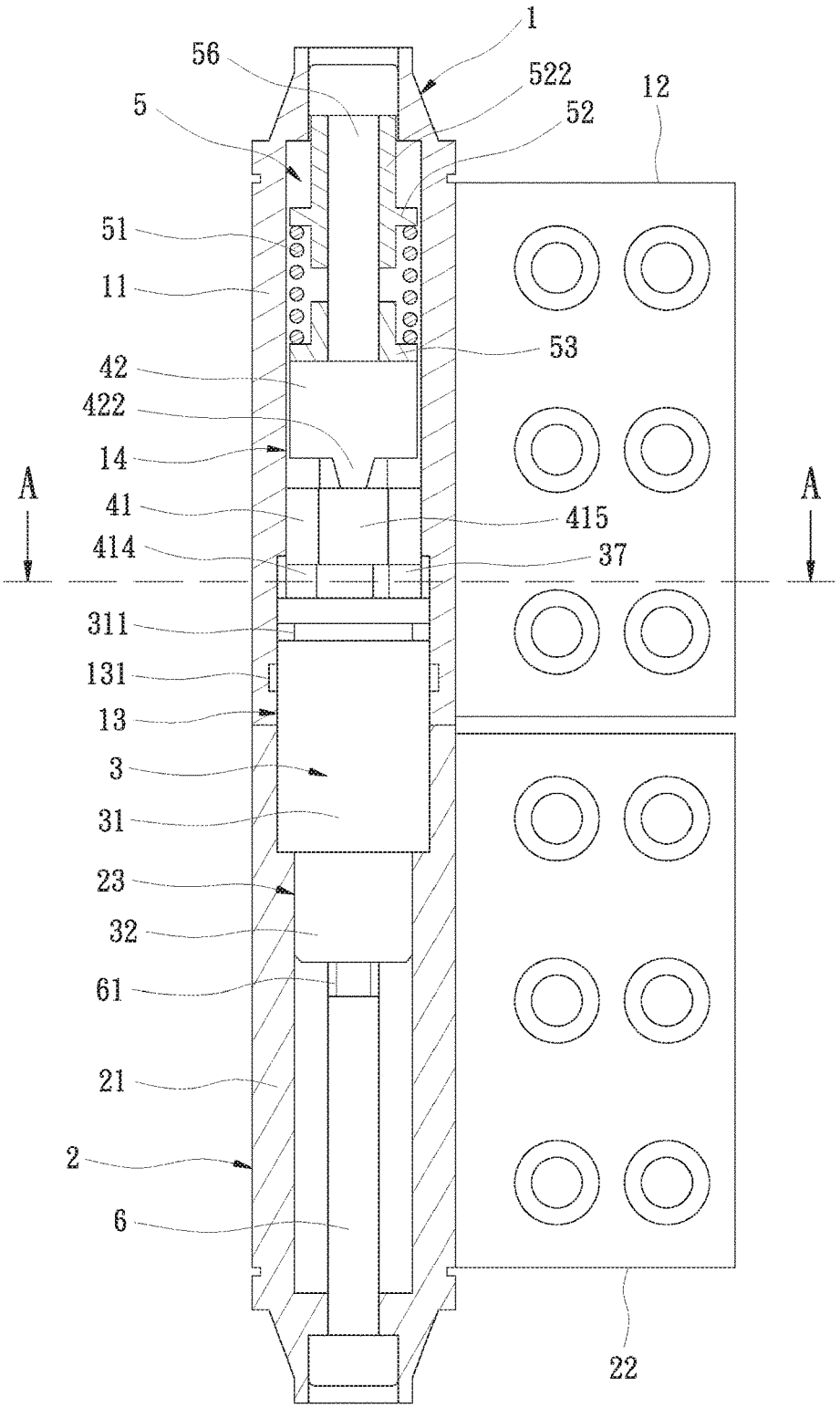
FIG. 3 is a longitudinal cross sectional view of the hinge device of FIG. 1 in the closed state.

With reference to FIGS. 1, 4, 5, and 10-12, a hinge device 10 according to the present invention includes a first connecting member 1, a second connecting member 2, an axle 3, a positioning device 4, and a retaining device 5.

The first connecting member 1 includes a first body 11 having a side on which a first connecting plate 12 is disposed. The first connecting plate 12 is adapted to be mounted to a door 7. A positioning space 13 and an actuating space 14 are defined in the first body 11 and are in communication with each other. The positioning space 13 includes an inner periphery having a guiding groove 131 that is annular. The actuation space 14 includes an inner periphery having non-circular cross sections.

The second connecting member 2 includes a second body 21 having a side on which a second connecting plate 22 is disposed. The second connecting plate 22 is adapted to be fixed on a door frame 8 to which the door 7 is pivotably mounted by the hinge device 10. The second body 21 includes a receiving space 23 having non-circular cross sections.

The axle 3 includes a base 31 having two sides. A fixing portion 32 and a shank portion 33 respectively extend from the two sides of the base 31. The axle 3 further includes two lubricating oil groove 311 and 333 for receiving lubricating oil. The shank portion 33 includes a distal end having an outer periphery. The outer periphery of the distal end of the shank portion 33 includes a positioning face 331 with non-circular cross sections. The base 31 of the axle 3 includes a limiting block 37 protruding from a location adjacent to the shank portion 33. The base 31 further includes a positioning hole 34 extending in a diametric direction perpendicular to a longitudinal axis of the base 31. An elastic element 35 and two positioning pins 36 are received in the positioning hole 34. The elastic element 35 is located between the two positioning pins 36 and biases the two positioning pins 36 to extend beyond the outer surface of the base 31. The positioning space 13 of the first connecting member 1 is coupled with the base 31 of the axle 3 via the distal end of the shank portion 33, and the two positioning pins 36 are biased by the elastic element 35 to extend into the guiding groove 131. Thus, the first connecting member 1 is pivotable about the base 31. The receiving space 23 of the second connecting member 2 is coupled with the base 31 via an end of the fixing portion 32. The fixing portion 32 includes an outer periphery having non-circular cross sections identical to the non-circular cross sections of the receiving space 23, such that the fixing portion 32 is securely received in the receiving space 23. After the first connecting member 1 and the second connecting member 2 are coupled to the base 31, a threaded portion 61 of the fastener 6 is coupled with a fixing hole 321 of the axle 3.

Figure 4:
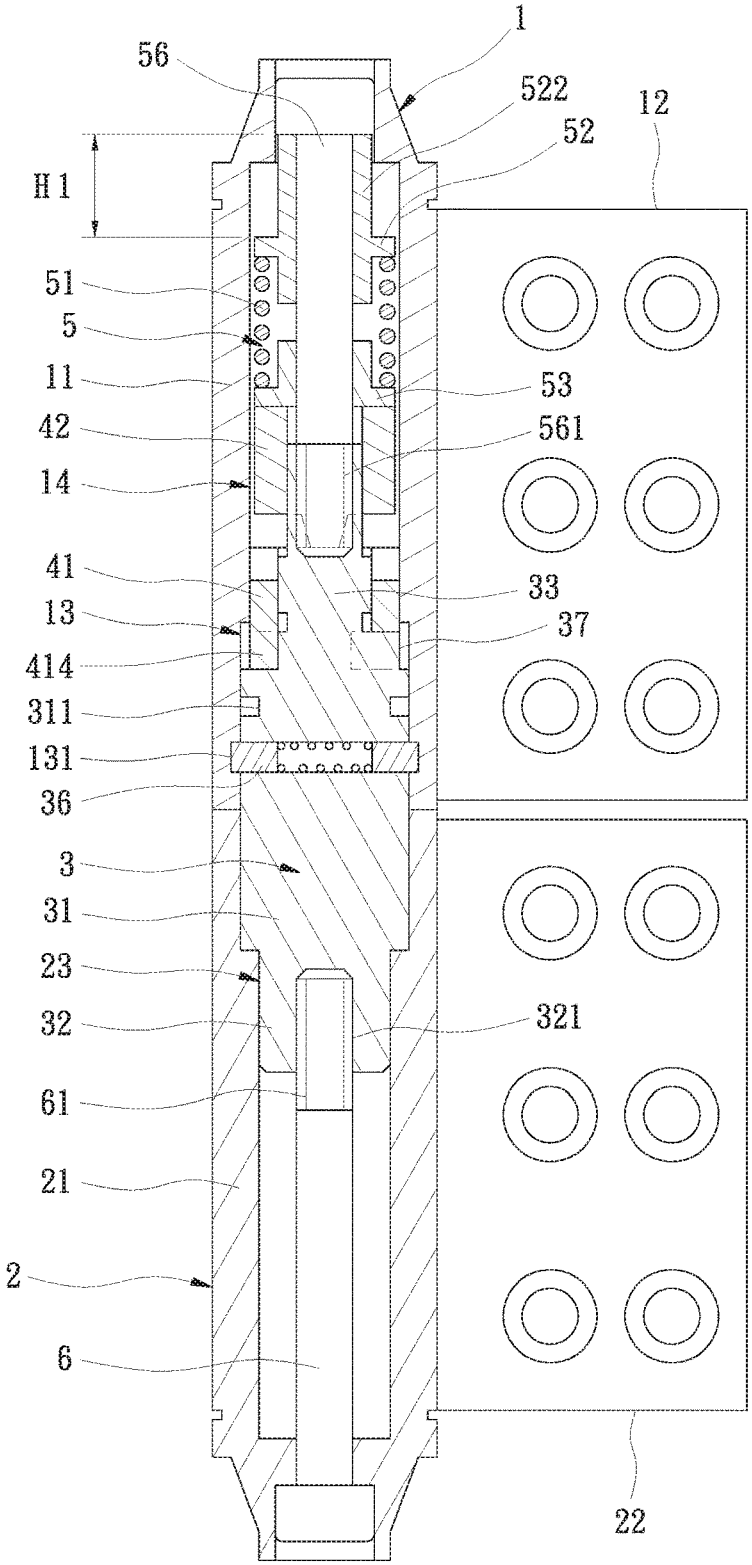
FIG. 4 is another longitudinal cross sectional view of the hinge device of FIG. 1 in the closed state.
Figure 5:
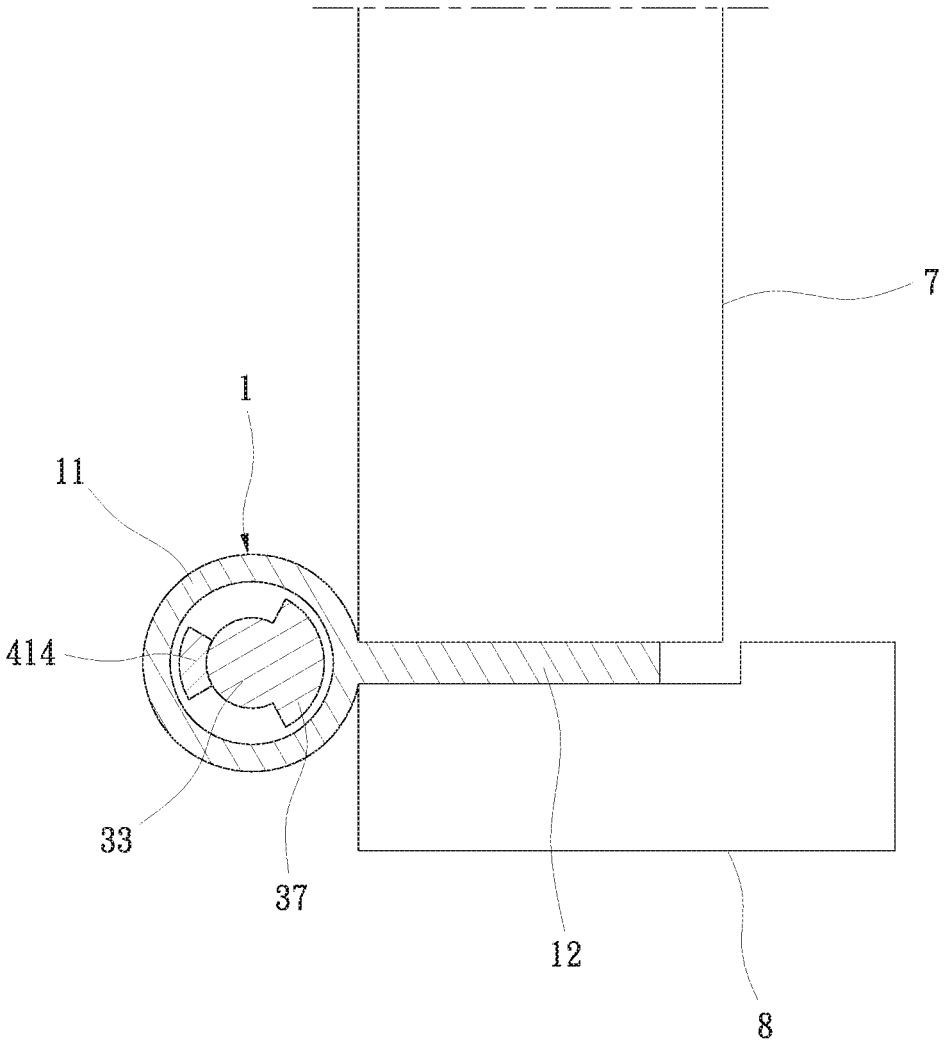
FIG. 5 is a cross sectional view taken along section line A-A of FIG. 3, with the hinge device mounted to a door and a door frame.
Figure 6:
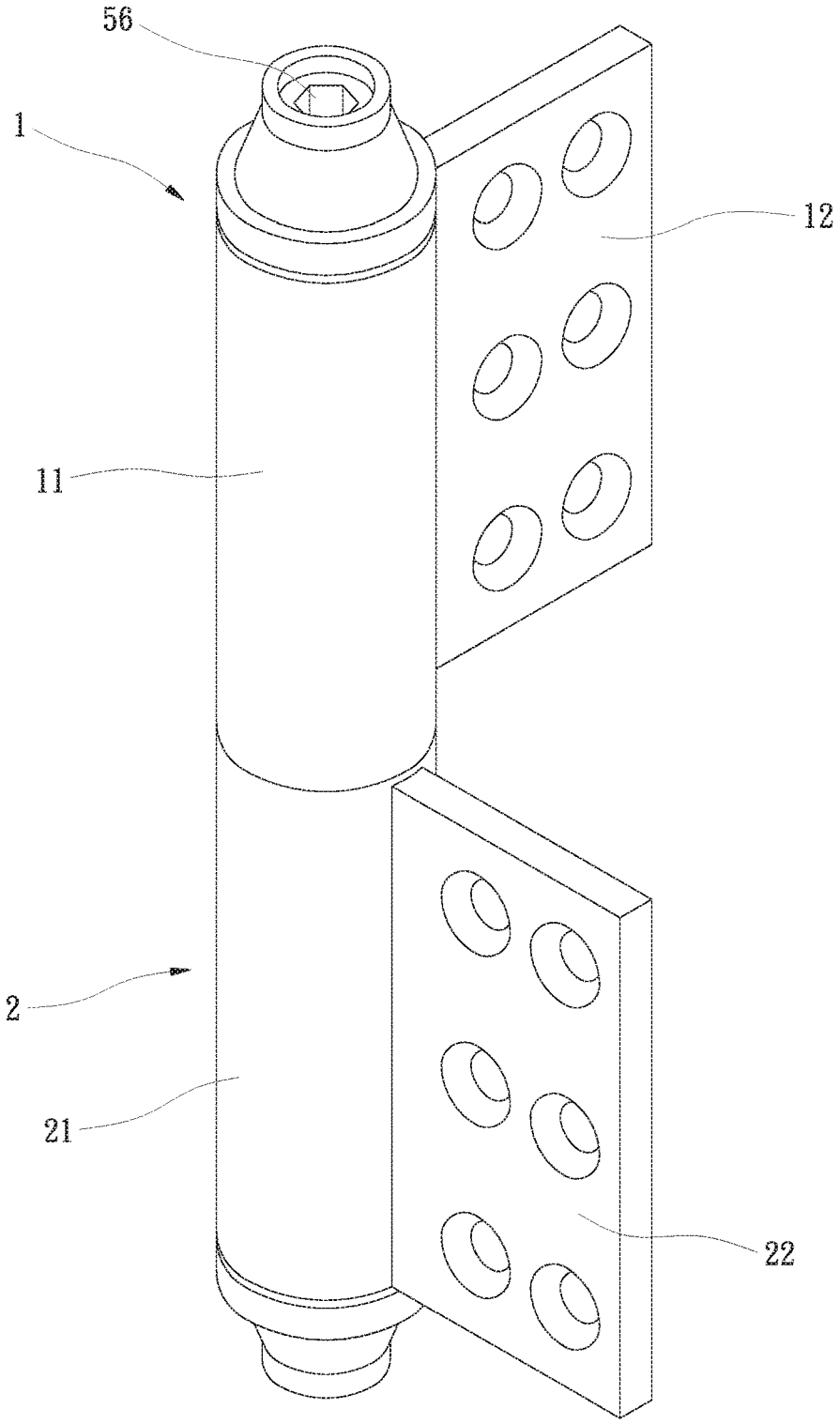
FIG. 6 is a perspective view of the hinge device according to the present invention in an open state.
Figure 7:
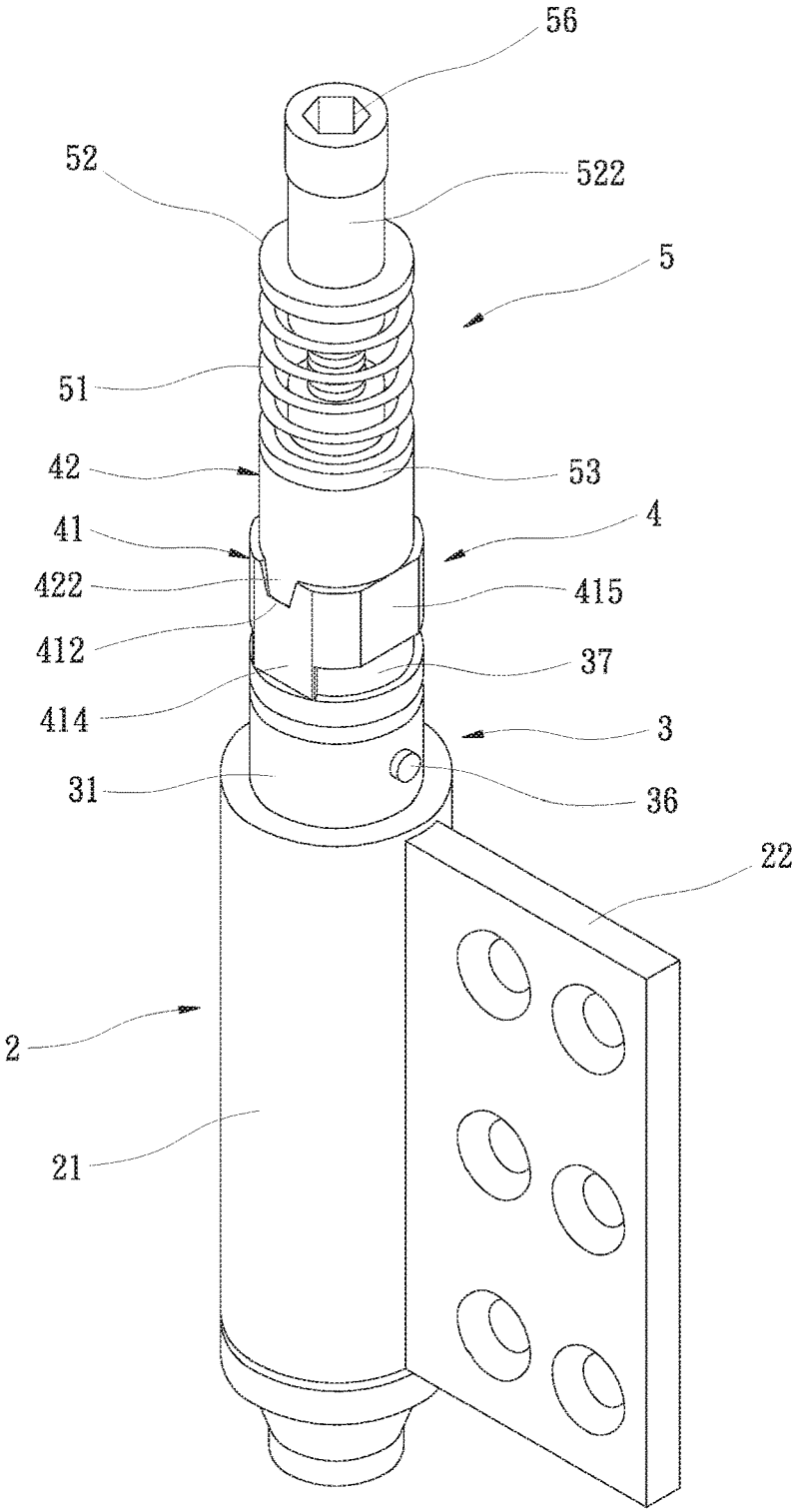
FIG. 7 is a partial, perspective view of the hinge device of FIG. 6 in the open state.
Figure 8:
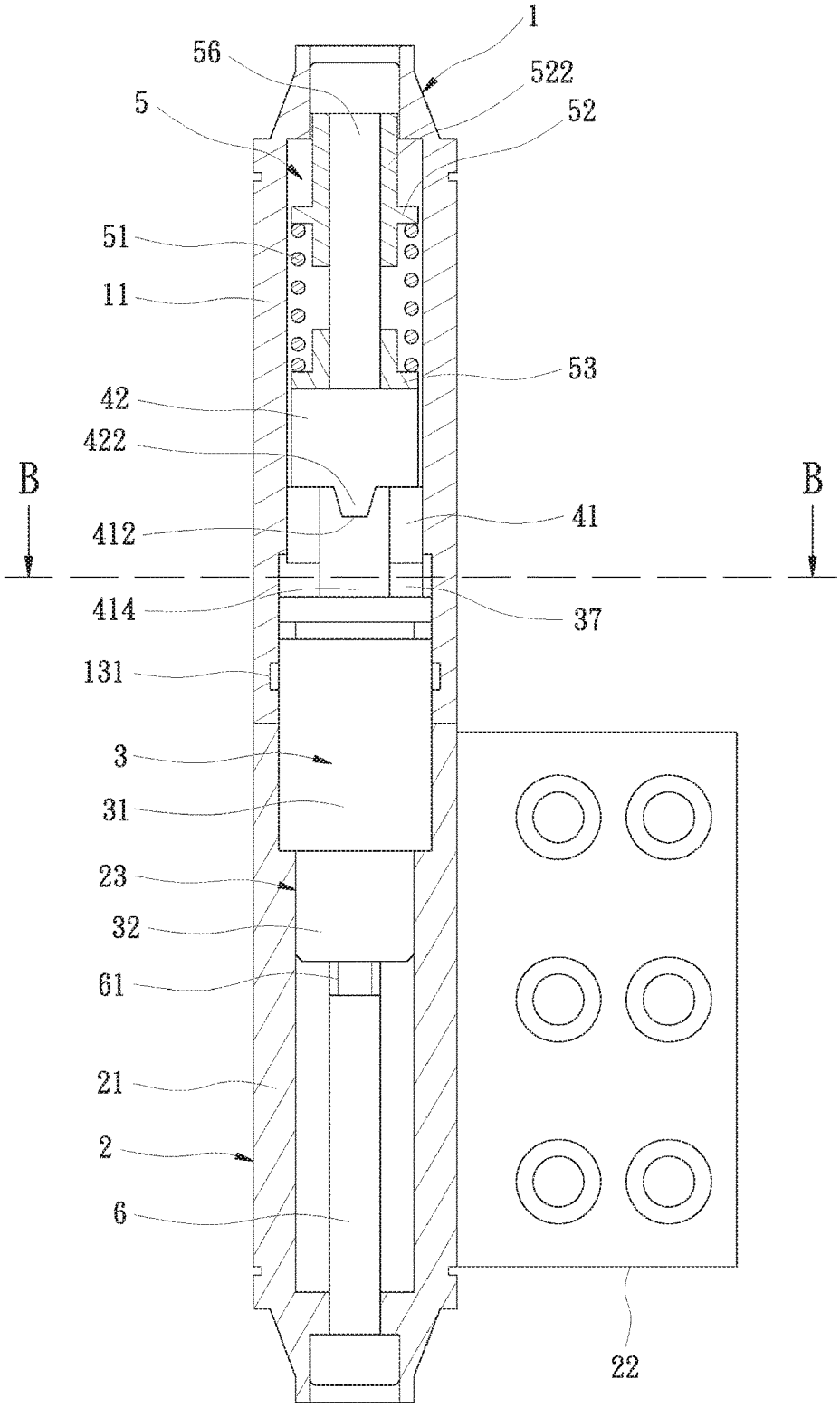
FIG. 8 is a longitudinal cross sectional view of the hinge device of FIG. 6 in the open state.
Figure 9:
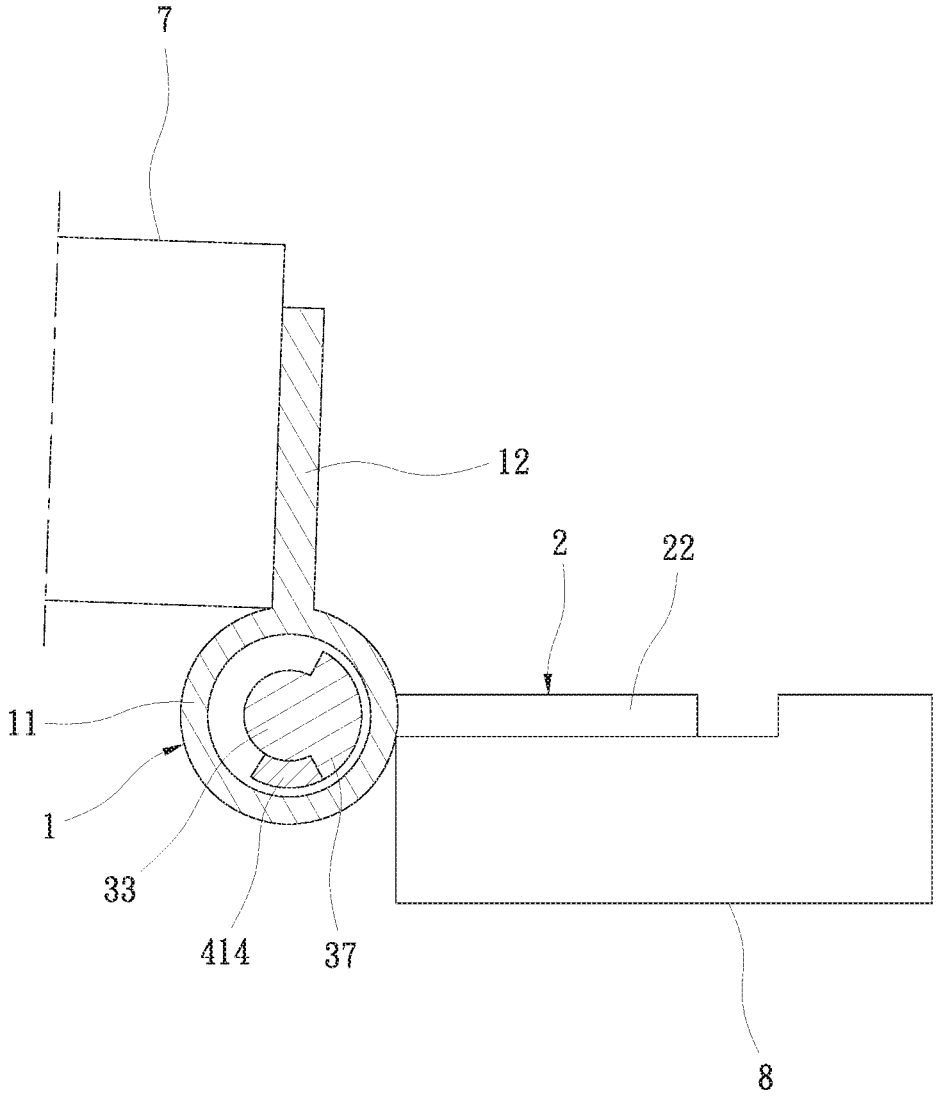
FIG. 9 is a cross sectional view taken along section line B-B of FIG. 8.
Figure 10:
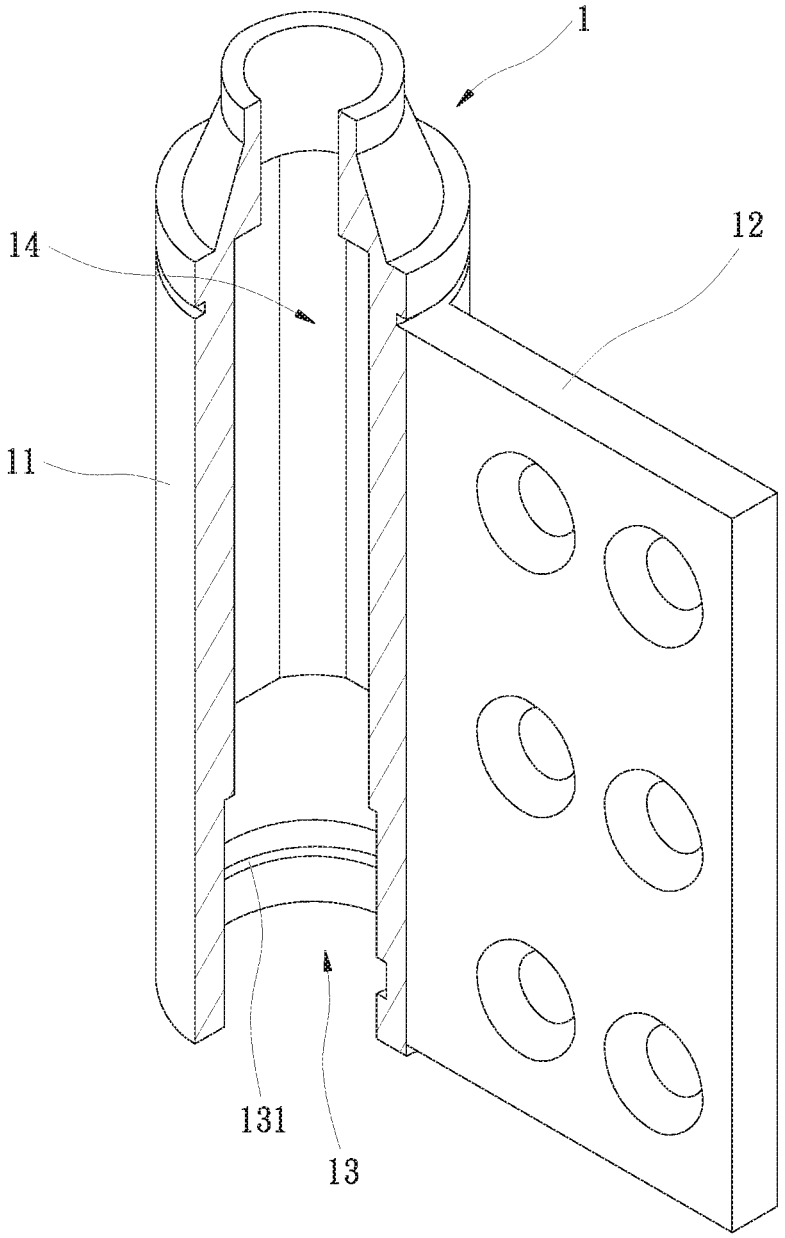
FIG. 10 is a partly-cutaway perspective view of a first connecting member of the hinge device according to the present invention.
Figure 11:
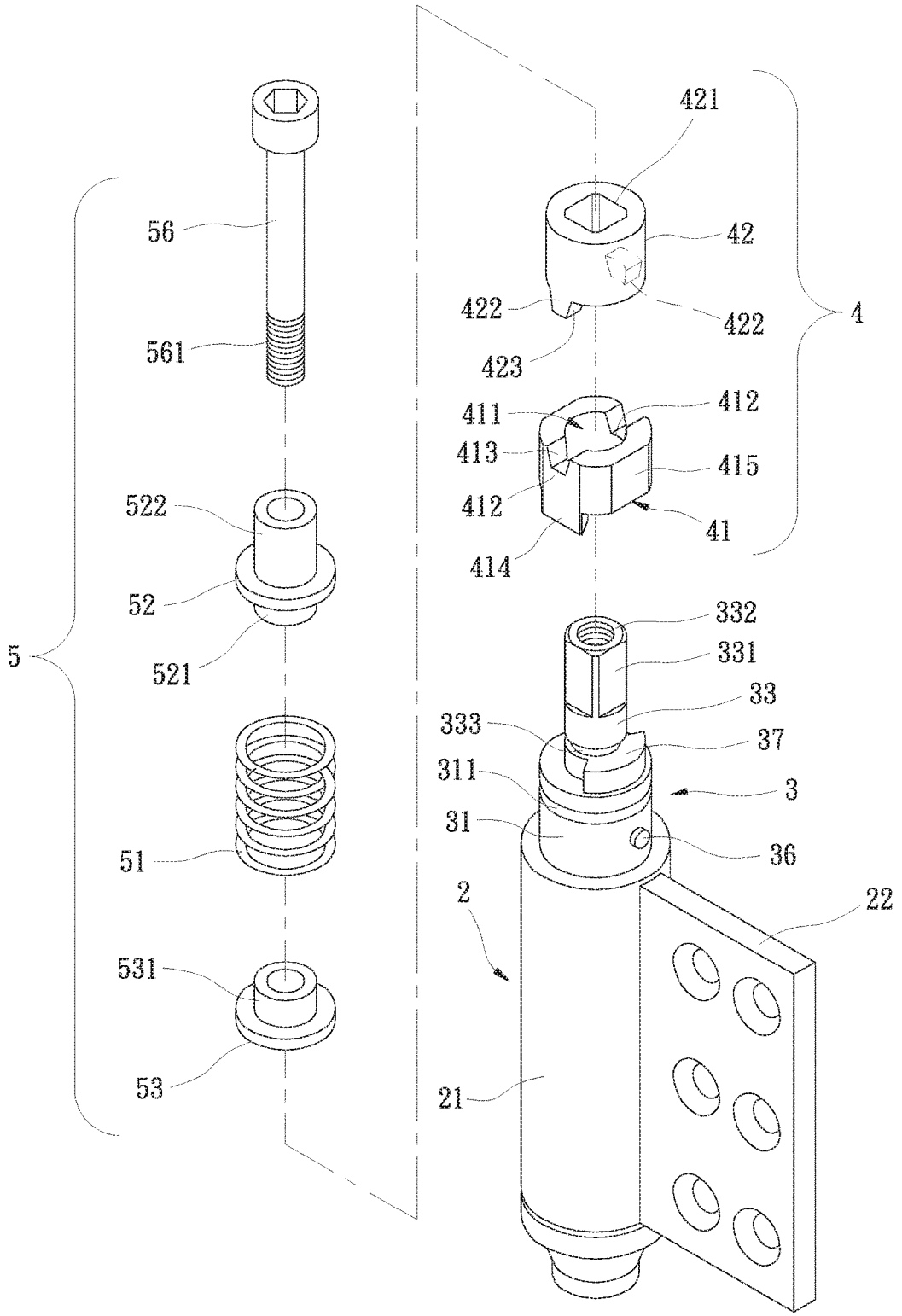
FIG. 11 is a partial, exploded, perspective view of the hinge device according to the present invention.
Figure 12:
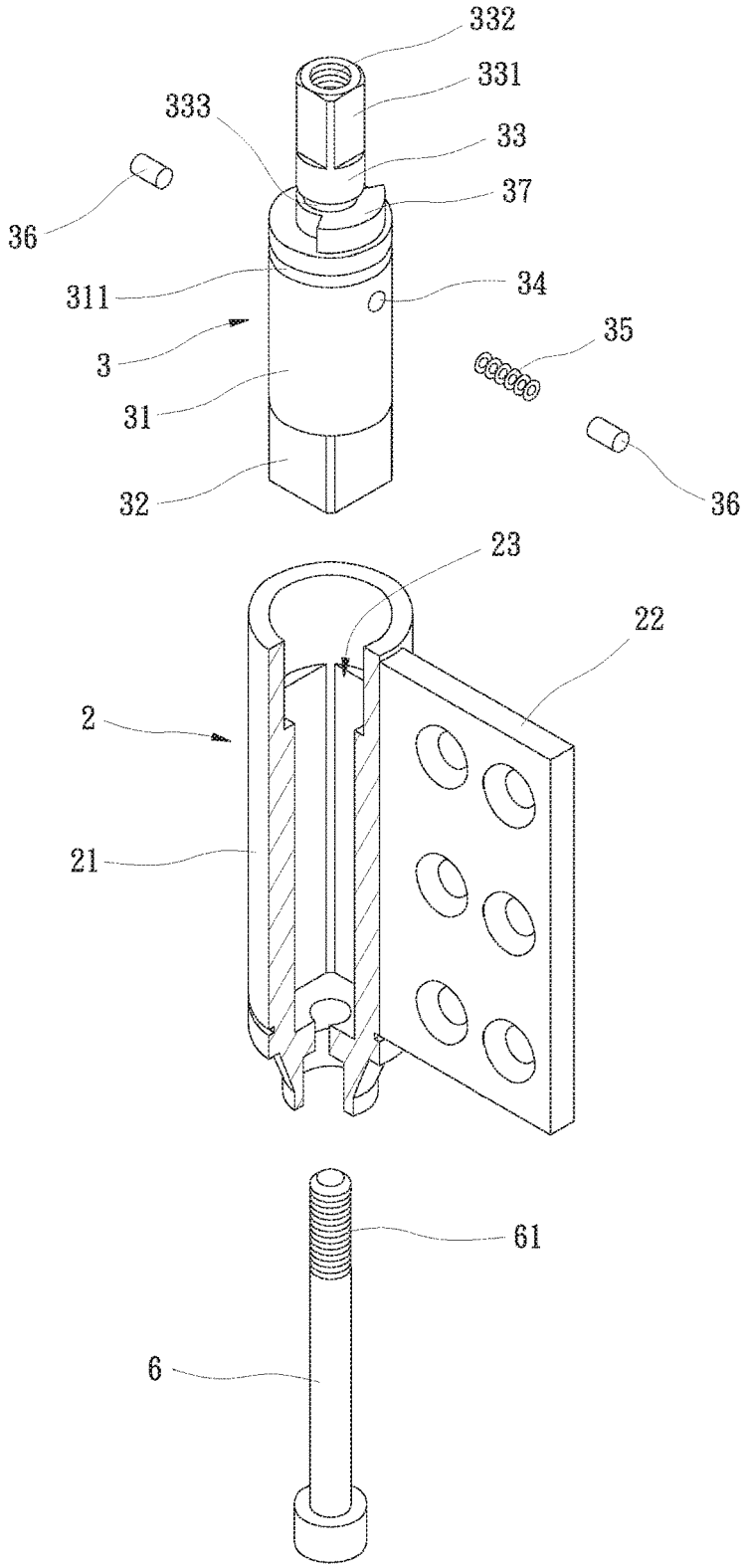
FIG. 12 is another partial, exploded, perspective view of the hinge device according to the present invention.

The positioning device 4 includes a rotary member 41 and a limiting member 42 (see FIGS. 4 and 11). The rotary member 41 and the limiting member 42 are mounted in the axle 3. The rotary member 41 of the positioning device 4 includes a pivotal space 411 pivotably receiving the shank portion 33 of the axle 3. The rotary member 41 includes a first surface facing the limiting member 42. The first surface of the rotary member 41 includes a plurality of positioning grooves 412 spaced from each other. Two guiding faces 413 are respectively on two sides of each positioning groove 412. A limiting leg 414 extends downward from a second surface of the rotary member 41 opposite to the first surface of the rotary member 41 and is located on a side of the limiting block 37, thereby restraining a pivotal range of the rotary member 41. The rotary member 41 further includes an outer periphery having an abutting face 415 with non-circular cross sections. The actuation space 14 has cross sections identical to the cross sections of the abutting face 415, such that the rotary member 41 is pivoted by pivotal movement of the first connecting member 1. The limiting member 42 includes a limiting space 421 having cross sections identical to the cross sections of the positioning face 331 of the shank portion 33. The limiting member 42 includes a first surface facing the rotary member 41. The first surface of the limiting member 42 includes a plurality of positioning legs 422 spaced from each other for releasably coupling with the positioning grooves 412. Two sliding faces 423 are respectively on two sides of each positioning leg 422.

The retaining device 5 is mounted in the first connecting member 1 and is mounted on top of the limiting member 42. The limiting member 42 is located between the retaining device 5 and the rotary member 41. The retaining device 5 biases the limiting member 42 toward the rotary member 41. The retaining device 5 includes an elastic element 51, a fastener 56, a positioning member 52, and an abutting member 53. The elastic element 51 includes two ends respectively abutting against the positioning member 52 and the abutting member 53. The abutting member 53 abuts against a second surface of the limiting member 42 away from the rotary member 41.

The positioning member 52 includes a first coupling portion 521. The abutting member 53 includes a second coupling portion 531 facing the first coupling portion 521. The elastic element 51 is a compression spring having the two ends. The two ends of the compression spring are respectively coupled to the first coupling portion 521 and the second coupling portion 531. The positioning member 52 further includes an adjusting portion 522 opposite to the first coupling portion 521. The fastener 56 extends through the positioning member 52, the elastic element 51, and the abutting member 53 in sequence and is fixed in a fixing hole 332 of the axle 3. The fastener 56 abuts against the adjusting portion 522 of the positioning member 52.

With reference to FIGS. 1-5, when the door 7 is in a closed state relative to the door frame 8, the distal ends of the positioning legs 422 of the limiting member 42 press against the first surface of the rotary member 41, and the abutting member 52 presses the elastic element 51 upward. The downward returning force of the elastic element 51 biases the limiting member 42 downward.

With reference to FIGS. 6-9, when the door 7 is opened, the first connecting member 1 moves jointly with the door 7 and actuates the rotary member 41 to pivot. When the rotary member 41 pivots to a position in which the positioning grooves 412 approach the positioning legs 422, the guiding faces 413 and the sliding faces 423 (FIG. 11) enable the positioning legs 422 to stably and smoothly enter the positioning grooves 412, such that the positioning legs 422 are securely engaged in the positioning grooves 412. A stop function is reliably provided for retaining the door 7 in an open position. Furthermore, when the door 7 is in the specific open position, the limiting legs 414 abut against the limiting block 37 to avoid excessive pivotal movement.

With reference to FIGS. 1-5 again, when the door 7 is closed, the guiding faces 413 and the sliding faces 423 (FIG. 11) permit the positioning legs 422 to smoothly ascend and to abut against the first surface of the rotary member 41.

Figure 13:
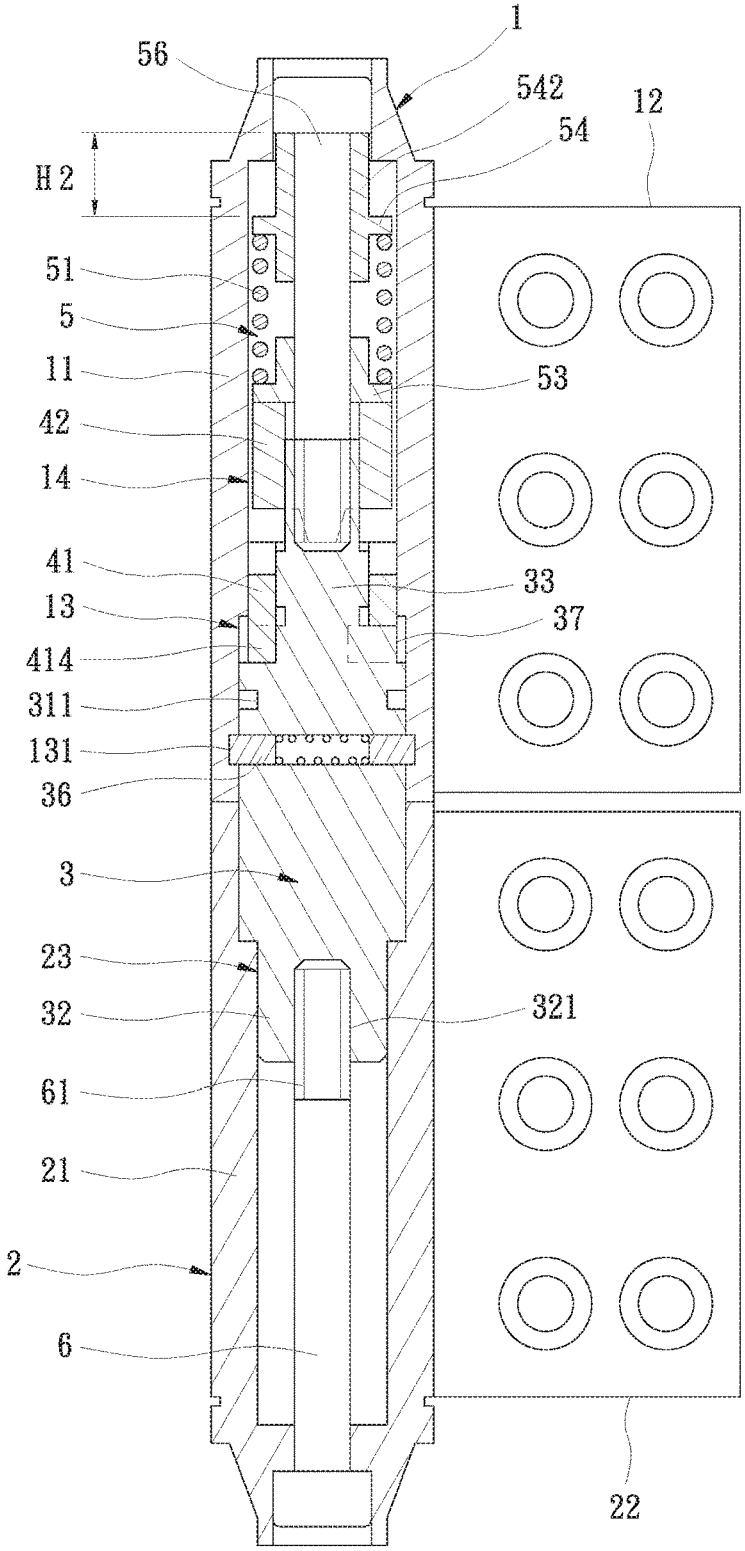
FIG. 13 is a cross sectional view illustrating adjustment of a positioning effect of the hinge device according to the present invention.
Figure 14:
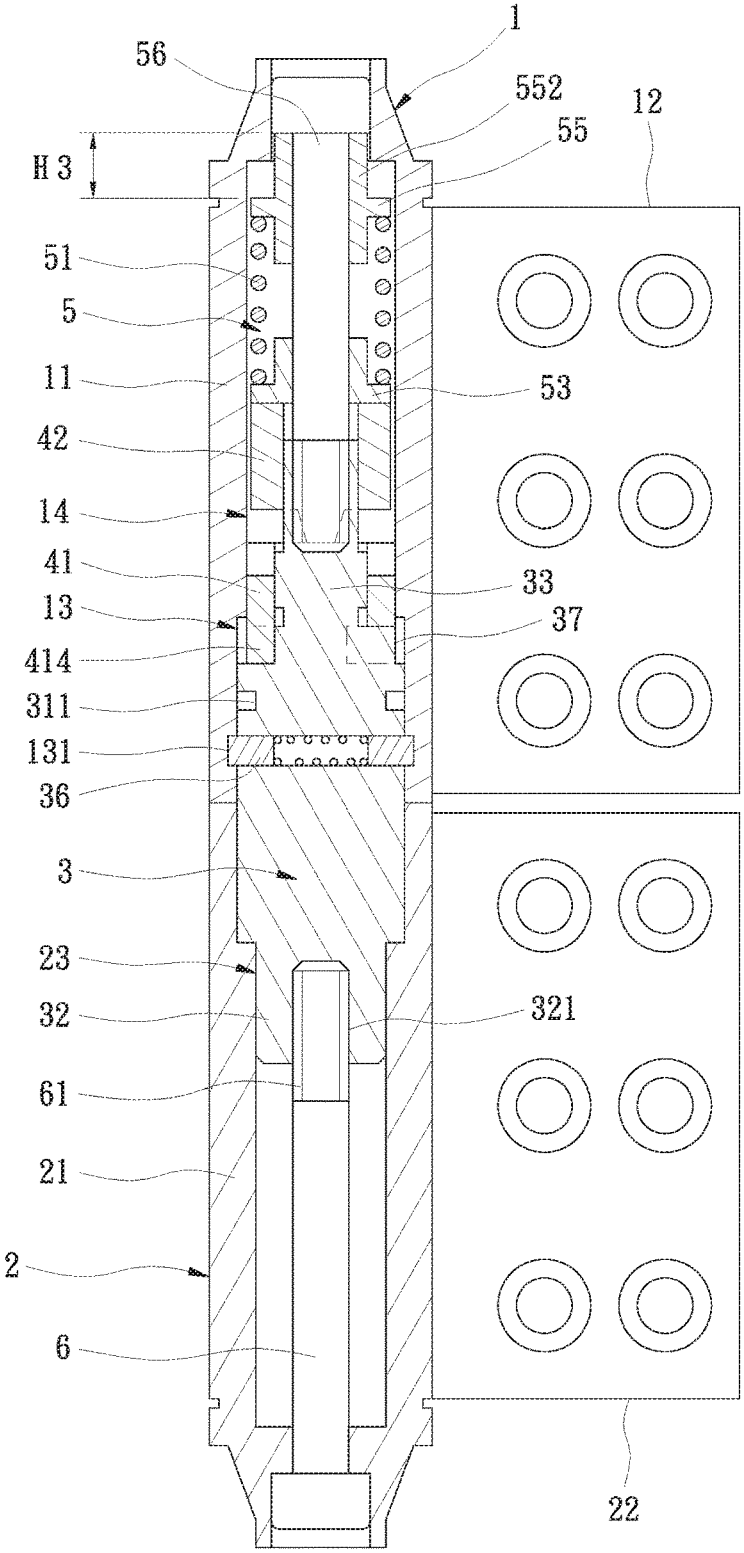
FIG. 14 is another cross sectional view illustrating adjustment of the positioning effect of the hinge device according to the present invention.

With reference to FIG. 4, the adjusting portion 522 of the positioning member 52 of the retaining device 5 has a first length H1 to abut against a head of the fastener 56, such that the positioning member 52 and the abutting member 53 have a fixed spacing therebetween, thereby providing a fixed returning force of the elastic element 51. In a case that closing of the door 7 is not smooth due to an excessively large returning force of the elastic element 51, the positioning member 52 can be replaced by a positioning member 54 having an adjusting portion 542 with a second length H2 (FIG. 13) smaller than the first length H1 or a positioning member 55 having an adjusting portion 552 with a third length H3 (FIG. 14) smaller than the first length H1 to increase the space of the elastic element 51, thereby reducing the returning force of the elastic element 51.

The hinge device according to the present invention can be mounted to a left-handed door or a right-handed door according to need. The door 7 can be retained in the open position after left-hand opening or right-hand opening. The hinge device according to the present invention has a simple, reliable structure and a low cost.

Although specific embodiments have been illustrated and described, numerous modifications and variations are still possible without departing from the scope of the invention. The scope of the invention is limited by the accompanying claims.

The invention claimed is:

1. A hinge device with a stop function, comprising:

a first connecting member;

a second connecting member pivotably connected to the first connecting member by an axle;

a positioning device mounted in the first connecting member, wherein the positioning device includes a rotary member and a limiting member, wherein the rotary member and the limiting member are mounted on the axle, wherein the rotary member includes a first surface facing the limiting member, wherein the first surface of the rotary member includes at least one positioning groove, wherein the limiting member includes a first surface facing the rotary member, wherein the first surface of the limiting member includes at least one positioning leg for releasably coupling with the at least one positioning groove, wherein the rotary member is actuatable by the first connecting member to pivot about the axle, wherein the limiting member is fixed on the axle;

a retaining device mounted in the first connecting member and mounted on top of the limiting member, wherein the limiting member is located between the retaining device and the rotary member, wherein the retaining device biases the limiting member toward the rotary member, wherein when the first connecting member pivots through an angle relative to the second connecting member, the at least one positioning groove of the rotary member is aligned with the at least one positioning leg of the limiting member, and the at least one positioning leg engages with the at least one positioning groove, thereby positioning the first connecting member relative to the second connecting member; and wherein the axle includes a base, wherein a fixing portion extends from a side of the base and includes an outer periphery having non-circular cross sections, wherein the second connecting member includes a receiving space having cross sections identical to the non-circular cross sections of the fixing portion, wherein the fixing portion is securely received in the receiving space, wherein the base includes a positioning hole, wherein an elastic positioning element and two positioning pins are received in the positioning hole, wherein the elastic positioning element is located between the two positioning pins, wherein the first connecting member includes a positioning space therein, wherein the positioning space includes an inner periphery having a guiding groove, wherein the base is received in the positioning space, wherein the two positioning pins are biased by the elastic positioning element to extend into the guiding groove, and wherein the first connecting member is pivotable about the base.

2. The hinge device with the stop function as claimed in claim 1, wherein the at least one positioning groove includes a plurality of positioning grooves spaced from each other, and wherein the at least one positioning leg includes a plurality of positioning legs spaced from each other.

3. The hinge device with the stop function as claimed in claim 1, wherein the retaining device includes an elastic retaining element, a fastener, a positioning member, and an abutting member, wherein the elastic retaining element includes two ends respectively abutting against the positioning member and the abutting member, and wherein the abutting member abuts against a second surface of the limiting member away from the rotary member.

4. The hinge device with the stop function as claimed in claim 3, wherein the positioning member includes a first coupling portion, wherein the abutting member includes a second coupling portion facing the first coupling portion, wherein the elastic retaining element is a compression spring having the two ends, wherein the two ends of the compression spring are respectively coupled to the first coupling portion and the second coupling portion, wherein the positioning member further includes an adjusting portion opposite to the first coupling portion, wherein the fastener extends through the positioning member, the elastic retaining element, and the abutting member in sequence and is fixed to the axle, wherein the fastener abuts against the adjusting portion of the positioning member, and wherein a pressing force acting on the abutting member by the elastic retaining element is adjustable by changing a length of the adjusting portion.

5. The hinge device with the stop function as claimed in claim 1, wherein the axle includes a base having two sides, where a fixing portion and a shank portion respectively extend from the two sides of the base, wherein the shank portion includes a distal end having an outer periphery, wherein the outer periphery of the distal end of the shank portion includes a positioning face with non-circular cross sections, wherein the first connecting portion is pivotably connected to the base portion, wherein the second connecting member is securely fixed to the fixing portion, wherein the rotary member of the positioning device includes a pivotal space pivotably receiving the shank portion of the axle, wherein the limiting member includes a limiting space having cross sections identical to the cross sections of the positioning face of the shank portion, wherein the rotary member includes an outer periphery having an abutting face with non-circular cross sections, wherein the first connecting member includes an actuation space therein, wherein the actuation space has cross sections identical to the cross sections of the abutting face, such that the rotary member is pivoted by pivotal movement of the first connecting member.

6. The hinge device with the stop function as claimed in claim 5, wherein the base of the axle includes a limiting block protruding from a location adjacent to the shank portion, wherein a limiting leg extends downward from a second surface of the rotary member opposite to the first surface of the rotary member, wherein the limiting leg is located on a side of the limiting block, thereby restraining a pivotal range of the rotary member.

7. The hinge device with the stop function as claimed in claim 1, wherein the rotary member of the positioning device includes two guiding faces respectively on two sides of the at least one positioning groove.

8. The hinge device with the stop function as claimed in claim 1, wherein the limiting member of the positioning device includes two sliding faces respectively on two sides of the at least one positioning leg.

* * * * *